US006499974B2

(12) United States Patent
Bach

(10) Patent No.: US 6,499,974 B2
(45) Date of Patent: Dec. 31, 2002

(54) PISTON PUMP

(75) Inventor: Björn Bach, Hamburg (DE)

(73) Assignee: Holger Clasen KG (GmbH & Co.), Hamburg (DE)

( * ) Notice: Subject to any disclaimer, the term of this patent is extended or adjusted under 35 U.S.C. 154(b) by 0 days.

(21) Appl. No.: 09/867,913

(22) Filed: May 30, 2001

(65) Prior Publication Data

US 2002/0015649 A1 Feb. 7, 2002

(30) Foreign Application Priority Data

May 31, 2000 (DE) ..... 200 09 848

(51) Int. Cl.[7] ..... F04B 39/10; F04B 53/12; F04B 39/08; F04B 19/00; F04B 37/00

(52) U.S. Cl. ..... 417/549; 417/545; 417/559; 417/562; 417/507; 417/470; 417/471

(58) Field of Search ..... 417/545, 549, 417/559, 562, 507, 470, 471

(56) References Cited

U.S. PATENT DOCUMENTS 3,347,264 A * 10/1967 Bunn et al. ..... 137/512.1
3,829,253 A * 8/1974 Bunn et al. ..... 137/512.1
5,037,276 A * 8/1991 Tremoulet, Jr. ..... 137/312
5,921,760 A * 7/1999 Isozumi et al. ..... 417/470

* cited by examiner

*Primary Examiner*—Charles G. Freay
*Assistant Examiner*—Timothy P. Solak
(74) *Attorney, Agent, or Firm*—Howson and Howson

(57) ABSTRACT

A piston pump having a piston axially movable against the force of a spring within an operating chamber connected via check valves to an operating cylinder and a hydraulic medium supply. A section of the piston that extends into the operating chamber has a reduced diameter extension which extends from a shoulder of the piston that delimits the operating chamber. The extension includes a thickened free end having a sealing surface facing the shoulder. A valve disk is located and guided on the extension in a gap between the shoulder and sealing surface and is capable of axially reciprocating movements thereon. The valve disk is provided with openings which provide a passageway for hydraulic medium from the operating chamber to a second check valve. The openings are blocked when the valve disk abuts the sealing surface.

10 Claims, 4 Drawing Sheets

PISTON PUMP

FIELD OF THE INVENTION

The invention concerns a piston pump with a pump housing and a piston, which, with its end surface and the pump cylinder delimits a displacement chamber, which is connected to a hydraulic medium supply via a first check valve and to an operating cylinder via a second check valve, wherein the piston moves axially in reciprocating fashion from one end position of the largest displacement volume to the other end position of the smallest displacement volume against the force of a spring. The invention especially pertains to a hydraulic pump for powering hydraulic tools.

BACKGROUND OF THE INVENTION

Piston pumps of this type are generally known and also serve to power pressing tools with high and very high pressures. Battery-operated drive motors with limited torque are often used for the mobile operation of such tools. In this context, the maximum pressure that can be produced in a pump of this type is also limited, since the torque produces the maximum force with which the piston can be driven in the pump cylinder.

OBJECTS OF THE INVENTION

The task of the invention is to improve a piston pump of the initially mentioned type so that higher pressures can be attained at equal maximum torque. Nonetheless, the pump should be configured in a simple manner.

SUMMARY OF THE INVENTION

The problem is solved according to the invention in that the section of the piston that extends into the displacement chamber is provided with an extension with a smaller diameter that connects to the end face of the piston via a shoulder and that has a thickened free end of the piston with a sealing surface facing said shoulder; in that a valve disk, which acts as a seal, is present between the shoulder and the sealing surface, which is brought into the pump cylinder, and through which the connection of the displacement chamber to the second valve is capable of being closed. The axial thickness of the valve disk is smaller than the gap between the sealing surface and the shoulder, so that the valve disk can be moved back and forth between the shoulder and the sealing surface, while the valve disk is provided with at least one opening through which the displacement chamber can be connected with the second check valve and which is closed when the valve disk is brought into contact with the sealing surface. Such a valve disk that is movable on the piston extension can be used to form a pump that operates in two stages, and which creates a high volume flow at relatively low pressures through the movement of the thickened end of the piston in the pump cylinder.

At relatively higher pressures, the return spring cannot completely retract the thickened end of the piston, against the pressure in the operating cylinder, and accordingly also the pressure in the displacement chamber. The displacement chamber further exhibits a stop on which, in a position of the piston between the end positions, the valve disk lies. Through the valve disk a small displacement chamber is formed that is only pressurized with the pressure of the shoulder surface of the piston. The free surface of the shoulder is provided to be smaller than the effective surface of the thickened end of the piston. In this way, the piston can produce higher pressure at the same torque and power. The operating method is described in detail below with reference to the drawings.

It is practical that, if the thickened end of the piston features a circumferential collar, the side of it, which faces toward the step, forms the sealing surface. The spring that rests on the side of the displacement chamber that lies across from the piston can engage the side of the collar that lies across from the sealing surface. In this manner a relatively large and powerful spring can be integrated into the displacement chamber so that correspondingly high pressures can be produced.

According to a preferred embodiment of the invention, the thickened end of the piston is configured as a hat-shaped piston sleeve that is mounted on the extension. Preferably the piston sleeve is mounted on the extension in such a way that it can be removed. In general, the piston unit is made up of three individual parts, the piston with the extension, the valve disk, and the piston sleeve, which are easy and inexpensive to produce. The piston sleeve can also be movable on the extension, as long as it can be ensured that a gap between the valve disk and the sealing surface or the step remains that depends on position. This gap can be very small, as long as the hydraulic medium can flow through it.

The piston can generally be driven as desired. It is practical if the piston is driven by a cam without guide rings. This has the advantage that freewheeling is possible in the direction of the bottom dead center, which is necessary because of the two-stage operating method, since the piston stands still at an intermediate point. The cam only operates during the compression phase in the direction of top dead center.

According to another embodiment of the invention, it is provided that the piston move within a sleeve that is inserted in the pump housing. This has the advantage that the piston unit with the return spring can be installed into a cylindrical displacement chamber of the pump housing, which is restricted by the sleeve in the downward direction. At the same time, this sleeve can form the stop for the valve disk, which is directly retained in the cylindrical recess of the pump housing while acting as a seal.

Generally, it is also possible that the valve disk is guided by the sleeve, set into the pump housing, that extends in the direction of the operating cylinder, while forming the stop for the valve disk. This has the advantage that the sleeve can be optimally fitted to the guide of the piston, on the one hand, and to the guide of the valve disk, on the other. Both measures allow the sleeve to consist of a different material than that of the piston and/or that of the pump housing.

BRIEF DESCRIPTION OF THE DRAWINGS

The invention is more closely described in the following by means of the schematic drawings. Shown are.

DETAILED DESCRIPTION OF THE PREFERRED EMBODIMENTS

Figure 1:
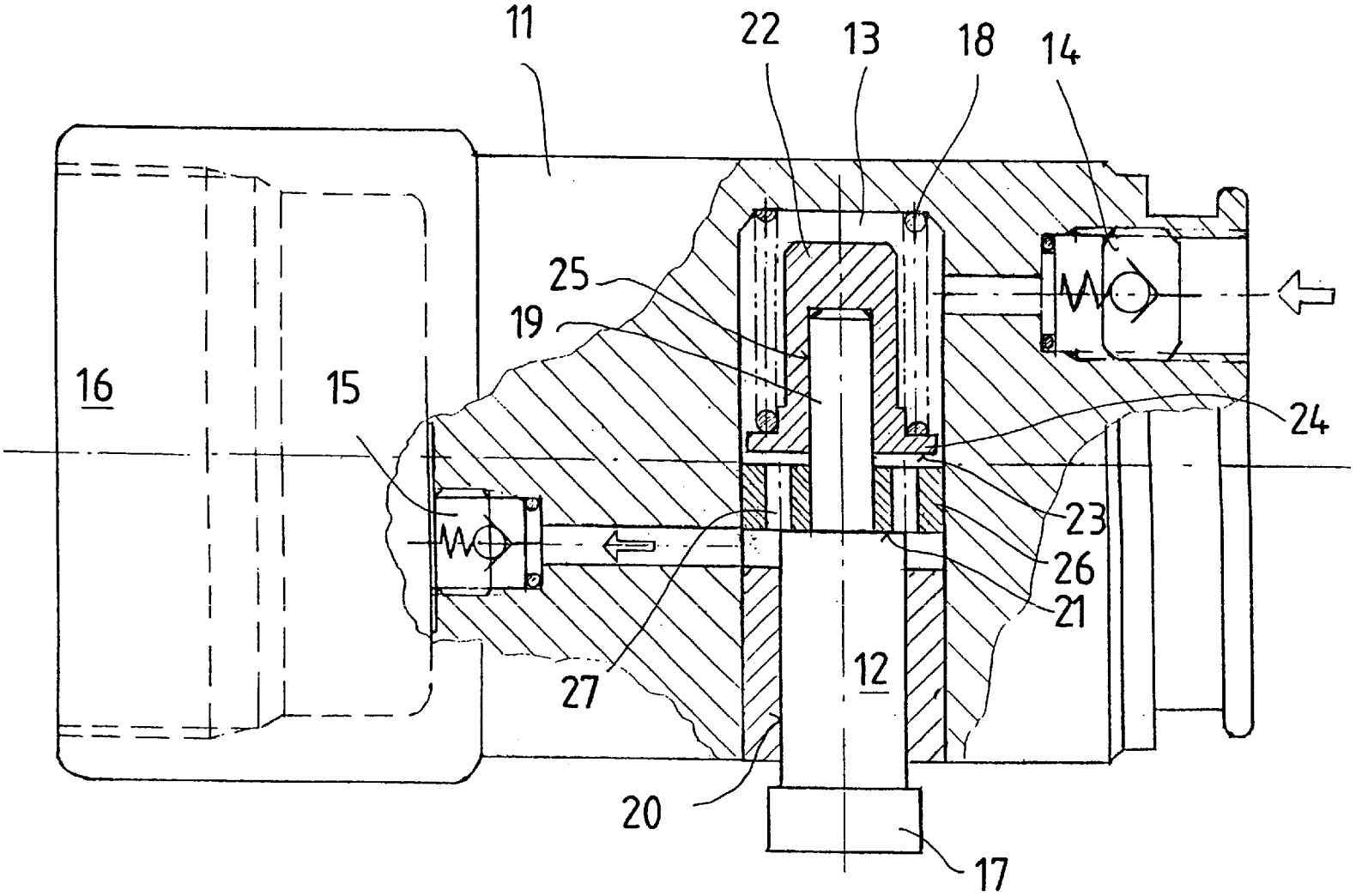
FIG. 1 a piston pump according to the invention with a piston at top dead center, FIG. 2 a piston pump according to FIG. 1 with the piston in an intermediate position, FIG. 3 a piston pump according to FIG. 1 with the piston at bottom dead center, and FIG. 4 a piston pump according to another embodiment of the invention with the piston at bottom dead center.

The pump shown in the drawing features pump housing 11 in which cylindrical piston 12 is set so that it can perform a reciprocating movement in cylindrical operating cylinder 13. Operating cylinder 13 is connected via first check valve 14 to a supply container for the pressure medium, particularly a hydraulic medium, such as oil. During the intake stroke of the piston (downwards in the drawing), the hydraulic medium enters the operating cylinder. There is a second check valve 15 through which the hydraulic medium enters operating cylinder 16 during the compression stroke of the piston (upwards in the drawing). Piston 12 is driven to top dead center against pressure spring 18 by an eccentric drive (not shown) that engages lower stop 17, which extends out of housing 11. The return to bottom dead center is due only to the spring force. In so far as the design corresponds to that of a conventional hydraulic piston pump, it requires no further explanation.

The section of piston 12 that extends into operating cylinder 13 includes cylindrical extension 19 which has a smaller diameter than shaft 20 of piston 12 and attaches to the piston by means of shoulder 21. Thickened end 22 of the piston, which features a sealing surface 23 on the side facing shoulder 21, is located on this extension. In detail, the attachment is configured in such a way that the thickened end of the piston is formed as a hat-shaped piston sleeve that is mounted on the extension. The piston sleeve features circumferential collar 24, which features sealing surface 23, on the one hand, and a stop for pressure spring 18, on the other.

The dimensions of the piston sleeve and its clearance 25 for extension 19 of the piston are arranged so that there is a gap exists between sealing surface 23 and shoulder 21. This can, of course, also be accomplished in that the piston features a clearance in which a pin with an appropriately thickened end is arranged. The parts must necessarily not be attached rigidly to one another. A sliding fit is more appropriate for a loose plug connection.

Figure 3:
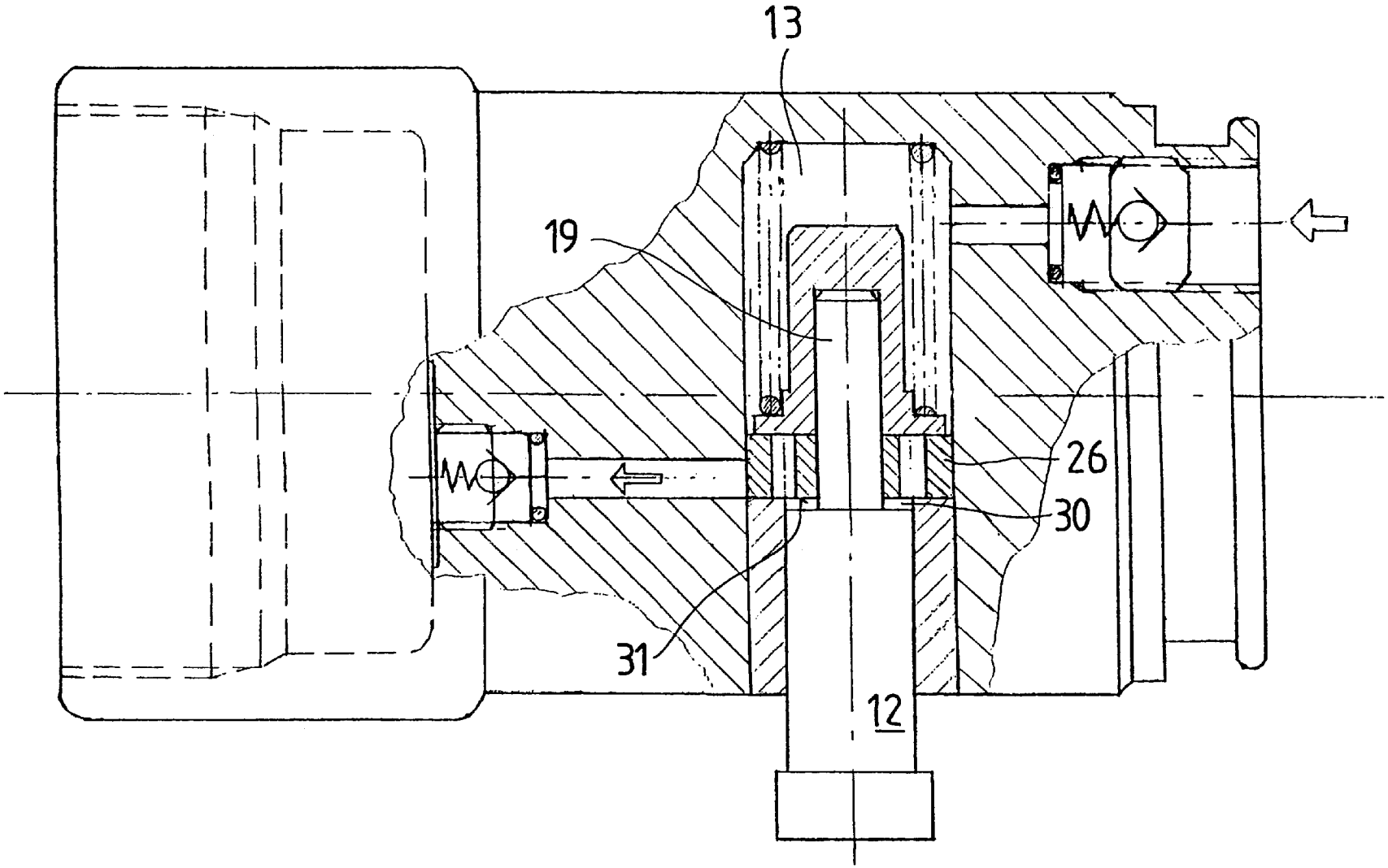

Valve disk 26, the thickness of which is less than the gap between sealing surface 23 and shoulder 21, lies between thickened end 22 of the piston and shoulder 21, acts as a seal, and is guided in the operating cylinder. Thus, by means of extension 19, the valve disk is capable of performing an axially reciprocating movement in the defined space. There are openings 27 in valve disk 26 that connect operating cylinder 13 with second check valve 15 in at least the top dead center position. If the valve disk abuts against sealing surface 23, however, as shown in FIG. 3, then the openings are shut. Moreover, the arrangement is configured in such a way that the valve disk, from an intermediate position of the piston toward bottom dead center, closes the connection between operating cylinder 13 and the second check valve, while acting as a seal. This connection 35 is now located, for this purpose, in the lower part of the operating cylinder, sealing it off in the region of the bottom dead center position of the piston.

Piston 12 is arranged in sleeve 28 in pump housing 11. Thus, among other things, stop 29 for valve disk 26 is formed, which previously limits its movement to the bottom dead center position of the piston. However, the piston will move farther in this direction because of the adjacent upper inner wall surface of the piston sleeve in such a way that chamber 30 remains between side 31 of valve disk 26, which faces shoulder 21, and the step.

Figure 4:
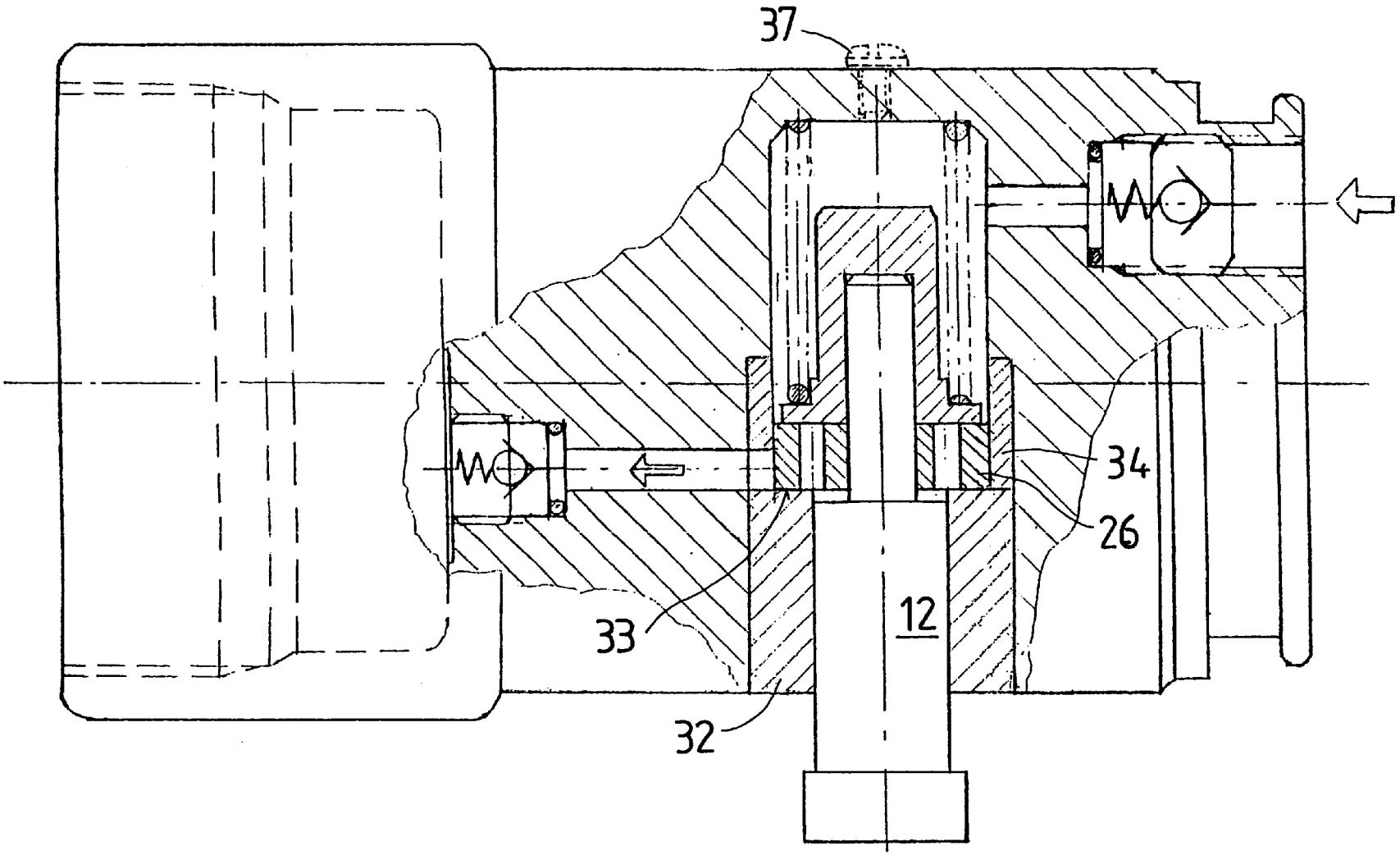

Sleeve 28, shown in the embodiment of FIGS. 1 though 3, is configured cylindrically. The valve disk is thus guided directly on the inner wall of operating cylinder 13, while acting as a seal. In the embodiment shown on FIG. 4, the sleeve features hollow cylindrical section 34 that extends in the direction of the operating cylinder over stop 33, in which the valve disk is guided while acting as a seal. Sleeve 32 and sleeve section 34 can be one piece or two individual sleeve section pieces. The material of sleeves 28, 32, 34 can be matched optimally to the requirements. In particular, a cost effective material can be used for the pump housing, as sleeves 28, 32, 34 provide the necessary sealing and sliding properties. The parts that move against one another in the drawing, piston shaft 20 in sleeves 28, 32, in particular, are shown without additional gaskets. Generally, elastic rubber gaskets can be provided here.

Further, operating cylinder 13 can feature at least one vent screw 37 to remove trapped air and to fill the operating cylinder with hydraulic medium. This ventilation is represented by dashed lines in FIG. 4 and may be included in the other embodiments as well.

Figure 2:
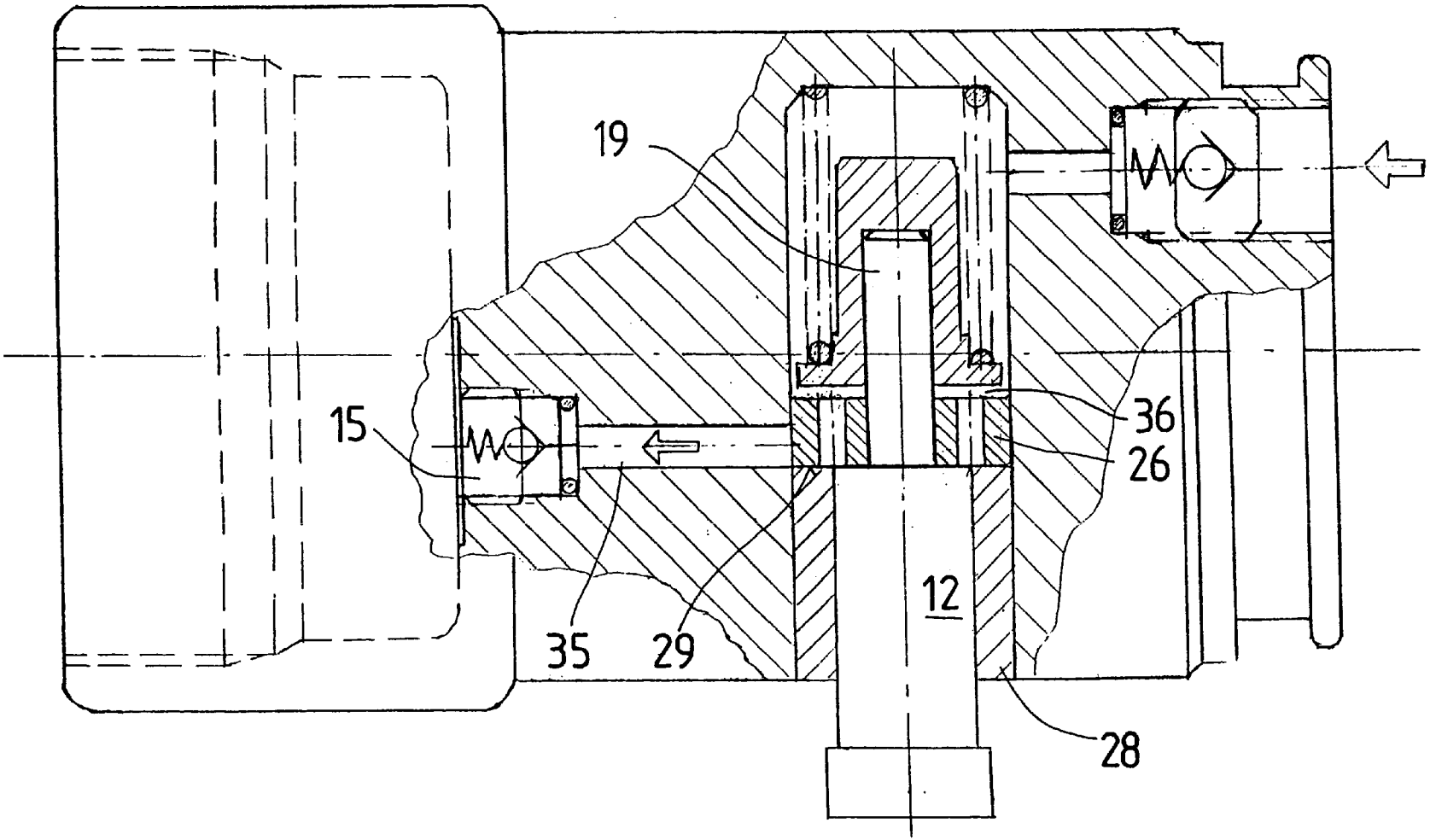

In the following, the operating method of the piston pump is explained starting from the top dead center position in FIG. 1. With a turning motion of the cam, piston 12 is no longer pushed upwards and the compression spring can move thickened end 22 of the piston, and thus the piston 12, to the bottom. The operating cylinder is decompressed, and second check valve 15 closes. First check valve 14 opens so that hydraulic medium can flow into operating cylinder 13. Valve disk 26 lies against shoulder 21. In progression of the stroke movement to the bottom, valve disk 26 strikes stop 29, 33 and stands still (FIG. 2). In this position, connection 35 to second check valve 15 is closed by the valve disk. Piston 12 is moved by thickened end 22 and extension 19 further into the bottom dead center position according to FIG. 3 or FIG. 4. Chamber 30 results between valve disk 26 and shoulder 21 of the piston, which is filled with hydraulic medium through openings 27.

Then the cam touches lower stop 17 again and pushes the piston up. The valve disk is then pushed up by the hydraulic medium in chamber 30, and the hydraulic medium comes into operating cylinder 16 through check valve 15. Further, in the progression of the stroke movement of the piston to the top dead center position, piston end 22 is pushed up further, and gap 36 is formed between sealing surface 23 and valve disk 26 so that the hydraulic medium can be pushed out of operating chamber 13 into operating cylinder 16.

This process is repeated up to a certain pressure, at which point compression spring 18 is no longer able to move thickened end 22 of the piston completely to the bottom against the hydraulic pressure. The upper end of the piston, as well as the piston, then remain in an intermediate position that allows new hydraulic medium to be brought into the operating chamber from the supply container. With a forced connection, extension 19 would move out of clearance 25 of the piston sleeve. After a corresponding rotation, the cam strikes the piston that has remained standing still.

Thus piston 12 only moves along a part of its maximum stroke in the high-pressure region. In particular, the pressure is no longer formed via the cam through the total surface of the thickened end of the piston. Rather, it is attained through the special configuration in which only shoulder surface 21, which is smaller, pushes the hydraulic medium. Accordingly, the required power is smaller even for higher pressures, so that the same torque of the motor can produce a higher pressure, which is available in the operating cylinder. In addition, the stroke movements of the piston only result in the top dead center region of the piston, and thus in the top angle positions of the cam, in which the transferable power is especially high.

What is claimed is:

1. A piston pump, comprising:

a pump housing (11);

a piston (12) which has an end surface that delimits an operating chamber (13) within said pump housing, said operating chamber (13) being connected to a hydraulic medium supply via a first check valve (14) and to an operating cylinder (16) via a second check valve (15), said piston (12) being axially moveable in reciprocating fashion within said operating chamber (13) from an end position providing a maximum displacement volume to an opposite end position providing a minimum displacement volume against a force of a spring (18);

a section of said piston (12), which extends into said operating chamber, having a reduced diameter extension (19) that extends from a shoulder (21) of said end surface of said piston (12), said extension (19) having a thickened end (22) providing a sealing surface (23) which faces said shoulder (21); and at least one valve disk (26) being located between said shoulder (21) and said sealing surface (23) and being guided within said operating chamber (13) to seal closed a connection (35) from said operating chamber (13) to said second check valve (15);

said valve disk (26) having an axial thickness that is less than a gap formed between said sealing surface (19) and shoulder (21) so that said valve disk (26) is movable back and forth on said extension (19) between said shoulder (21) and said sealing surface (23); and said valve disk (26) being provided with at least one opening (27) providing a passageway for hydraulic medium from said operating chamber (13) to said second check valve (15), said opening (27) being sealed shut when said valve disk engages said sealing surface (23).

2. A piston pump according to claim 1, wherein said thickened end (22) of said piston (12) has a surrounding collar (24) that forms said sealing surface (23).

3. A piston pump according to claim 2, wherein said spring (18) engages a side of said collar (24) opposite said sealing surface (23).

4. A piston pump according to claim 3, wherein said thickened end (22) of said piston (12) is configured as a hat-shaped piston sleeve that is mounted on said extension (19).

5. A piston pump according to claim 1, wherein said shoulder (21) has a surface area which is smaller than the surface area of said thickened end (22) of said piston (12).

6. A piston pump according to claim 1, wherein said piston (12) is driven by a cam.

7. A piston pump according to claim 1, wherein said operating chamber (13) includes a stop (29, 33) on which said valve disk (26) rests, in an intermediate position of said piston (12) between said end positions, and in which position said connection (35) to said second check valve (15) is closed.

8. A piston pump according to claim 1, wherein said piston (12) is guided in a sleeve (28, 32) arranged in said pump housing (11).

9. A piston pump according to claim 8, wherein said valve disk (26) is guided in said sleeve (32) which extends in a longitudinal direction of said operating chamber and which forms a stop (33) for said valve disk (26).

10. A piston pump according to claim 8, wherein said sleeve (28, 32) is made from a different material than that of at least one of said piston (12) and said pump housing (11).

* * * * *

UNITED STATES PATENT AND TRADEMARK OFFICE

CERTIFICATE OF CORRECTION

PATENT NO. : 6,499,974 B2 
DATED : December 31, 2002
INVENTOR(S) : Bach

It is certified that error appears in the above-identified patent and that said Letters Patent is hereby corrected as shown below:

Title page, Item [54] and Column 1, line 1,
Title should read -- PISTON PUMP WITH RECIPROCATING VALVE DISK--

Column 6,
Line 15, "driven by a cam" should read -- driven by a cam without a guide ring --.

Signed and Sealed this

Nineteenth Day of August, 2003

JAMES E. ROGAN
*Director of the United States Patent and Trademark Office*